United States Patent [19]

Morrison et al.

[11] 4,102,549

[45] Jul. 25, 1978

[54] APPARATUS FOR ADJUSTING THE BACK SUPPORT OF A CHAIR

[75] Inventors: Andrew I. Morrison, Setauket; Bruce R. Hannah, Cold Spring, both of N.Y.

[73] Assignee: Knoll International, Inc., Greenwich, Conn.

[21] Appl. No.: 787,147

[22] Filed: Apr. 13, 1977

[51] Int. Cl.[2] ..... B60N 1/02

[52] U.S. Cl. ..... 297/383; 297/353; 297/410

[58] Field of Search ..... 297/337, 338, 344, 345, 297/353, 383, 410

[56] References Cited

U.S. PATENT DOCUMENTS

| | | | |
|---|---|---|---|
| 2,054,557 | 9/1936 | Cramer et al. | 297/383 X |
| 3,572,834 | 3/1971 | Herzer et al. | 297/410 |

*Primary Examiner*—James C. Mitchell

*Attorney, Agent, or Firm*—Cooper, Dunham, Clark, Griffin & Moran

[57] ABSTRACT

Apparatus for adjusting a back support of a chair which includes a bracket through which the back support slides. A position stop of flexible sheet material is mounted adjacent to the back support. A stop member is included on the back support, while the position stop includes apertures therein. The stop member is engaged in one of the apertures to lock the back support in position. To move the back support, the position stop is flexed to a disengaged position in which the stop member is free from the apertures. After being moved, the position stop is allowed to return to the engaged position in which the stop member is engaged within another aperture.

3 Claims, 4 Drawing Figures

APPARATUS FOR ADJUSTING THE BACK SUPPORT OF A CHAIR

BACKGROUND AND SUMMARY OF THE INVENTION

This invention relates to chairs, especially to secretarial type chairs, in which it is desired that the back support member be adjustable. It is especially desirable to have a back support member which readily can be adjusted for both vertical and horizontal positioning of the back support cushion of the chair to suit the comfort of the user. It is important that the mechanism to adjust the back support of the chair not only be simple and easy to use, but that its method of operation be obvious to the user at a glance.

The prior art is mainly directed to spring-loaded back support adjustment mechanism utilizing a pin which engages one of a plurality of apertures in a sliding back support member. This type of art and other art in this field are as follows:

| U.S. Pat. No. | Patentee |
|---|---|
| 2,030,635 | Horwitt et al |
| 2,040,942 | Katenkamp |
| 2,054,557 | Cramer et al |
| 2,454,057 | Grunwald |
| 2,568,988 | Childs |
| 2,595,901 | Sperring |
| 2,662,586 | Cramer |
| 2,678,680 | Haltenberger |
| 3,224,807 | Welch et al |
| 3,720,443 | Mourgue |

It is an object of this invention to provide an easily manipulated and simple-to-operate aparatus for adjusting the back support of a chair.

It is also an object of this invention to provide apparatus for adjusting the back support of a chair which is simple and inexpensive to fabricate and install and which does not require spring loading.

These objects are achieved by providing an adjustable back support using a position stop of flexible sheet material which may be flexed from an engaged position in which the back support of the chair is locked by the position stop to a disengaged position in which the back support is movable.

The invention will be more completely understood by reference to the following detailed description.

DETAILED DESCRIPTION

Figures 1, 2, 3, 4:
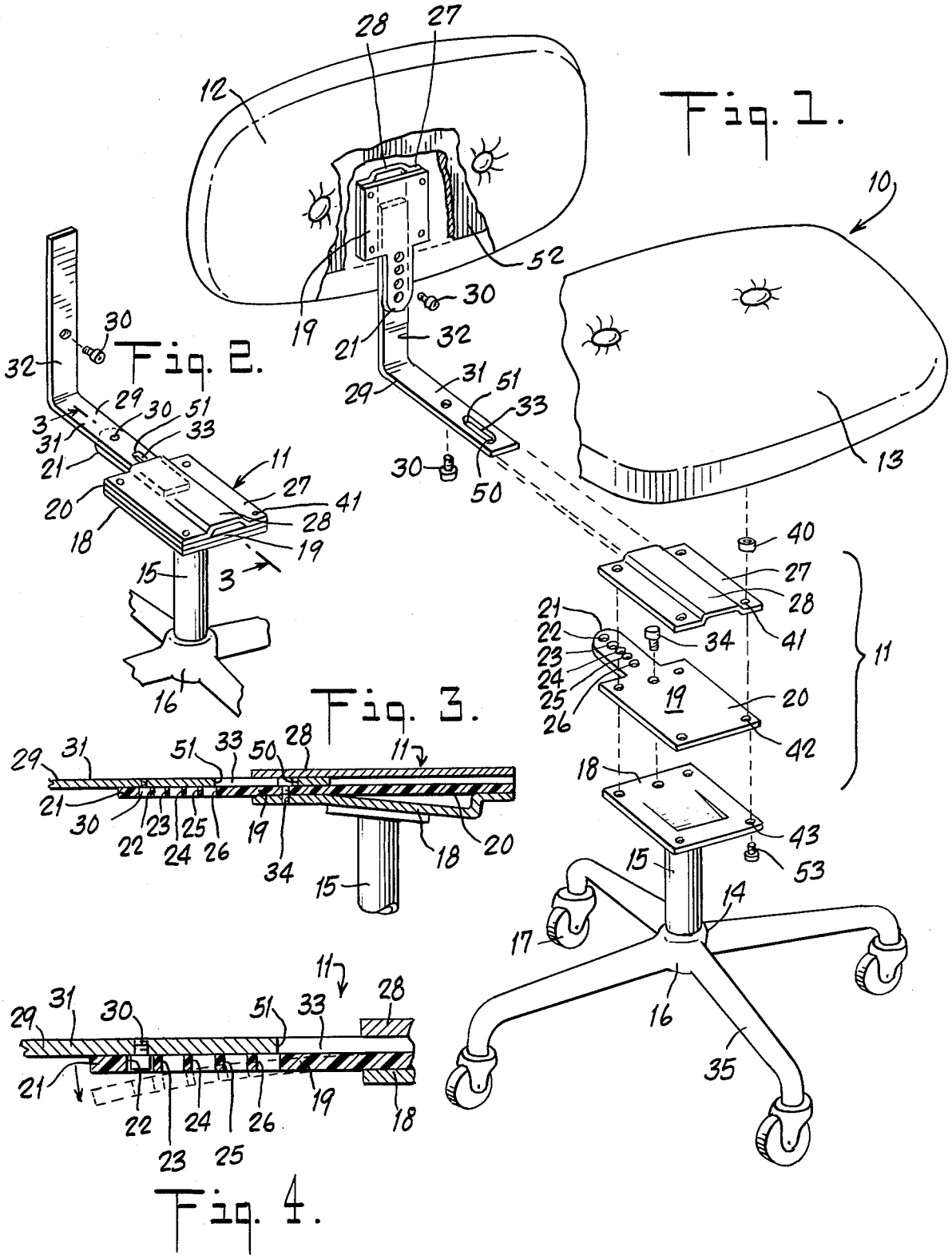
FIG. 1 is an exploded perspective view of a chair embodying the invention.
FIG. 2 is a perspective view of the base and back support structure of the chair of FIG. 1 in assembled form.
FIG. 3 is a sectional view, to an enlarged scale, taken along section 3—3 of FIG. 2.
FIG. 4 is a view similar to FIG. 3 showing the flexing movement of the back support adjustment mechanism.

FIG. 1 shows an exploded view of chair 10 including a support unit 11, back support cushion 12, seat cushion 13 and base assembly 14. Base assembly 14 is composed of conventional pedestal 15, hub 16, limbs 35 and casters 17. Back support cushion 12 is coupled to leg 32 of L-shaped support member 29 whose other leg 31 is part of support unit 11. Seat 13 is attached to support unit 11.

Support unit 11 comprises baseplate 18, flexible position stop 19 (flexible sheet material), and slide bracket 27. The parts of base 11 are shown exploded in FIG. 1 and assembled in FIGS. 2 and 3. Pedestal 15 supports unit 11 and is attached to baseplate 18. Flexible position stop 19, composed of body 20 and flap 21, lies atop baseplate 18. Screw 34, whose function will be described below, is located at the rearward part of body 20, next to flap 21. Flap 21 is formed with a series of apertures 22–26 therein, the number, spacing and type of which may be varied, as desired. Atop position stop 19 lies slide bracket 27 containing track 28, through which leg 31 of back support 29 slides. Seat 13 rests upon and is attached to slide bracket 27. Support unit 11 is held together by bolts extending through holes in the corners of slide bracket 27, body 20 of position stop 19, and baseplate 18, such as bolt 53 through holes 41, 42 and 43. In addition, bolt 53 can be used to attach together seat 13 and unit 11. In attaching seat 13 to support unit 11, spacers such as spacer 40 are used to compensate for the height of track 28.

The preferred embodiment of the apparatus imposes limits on the distance within base 11 through which leg 31 of supporting member 29 may slide. To this end, supporting member 29 contains groove 33 into which bolt 34, described above, is positioned. Supporting member 29 is thus prevented from sliding a distance greater than the groove 33, (end 50 or 51 of groove 33 contacts bolt 34, stopping supporting member 29 from sliding any further).

FIGS. 2 and 3 show the assembled relationship of flexible position stop 19 and leg 31 of supporting member 29 within base 11. Both flexible position stop 19 and leg 31 have flat surfaces facing each other. Thus, body 20 of stop 19 lies flat against leg 31 of support member 29, allowing leg 31 to slide smoothly through track 28. The flap 21 of position stop 19 naturally takes the position against leg 31 as shown in FIG. 3, as its resiliency and normally planar shape biases it to that position. In this position, stop member 30 (e.g., a screw) attached to leg 31 is positioned within one of apertures 22–26 in flap 21, fixing the back support 29 in place. When flap 21 is pulled away from its position against support member 29 (as shown by the dashed line position in FIG. 4) back support 29 may be adjusted. Thus screw 30 is disengaged from hole 22 (for example), allowing supporting member 29 to slide freely through track 28. When one finds the position at which back support cushion 12 is comfortable, flap 21 is released and its resiliency returns it upwardly to its original position against leg 31 of support 29. Again, one of holes 22–26 engages screw 30, locking sliding supporting member 29 in place. It will be seen from FIG. 4 that the stop member 30 protrudes away from the leg 31 of the supporting member 29 for a distance no greater than about the thickness of the flexible position stop 19, i.e., for a distance no greater than about the depth of the apertures 22–26. In this fashion the stop member 30 is substantially hidden from view, and the only part of the adjustment mechanism that is visible is the flexible position stop which lies flat against the leg 31 of the back support 29.

The horizontal sliding adjustment movement of the horizontal leg 31 of back support 29 just described provides for apropriate adjustment in a horizontal direction of the back support cushion 12. Vertical adjustment of the back support cushion 12 may be achieved in the same fashion. In particular, the vertical leg 32 of the L-shaped back support 29 may ride within the track 28 of a slide bracket 27 attached to an internal stiffening plate 52 located inside the cushion 12, as shown in FIG. 1. A flexible position stop 19 is also included, the flap 21 of which adjustably engages stop member screw 30. No slot 33 and associated limit stop member 34 are included in the case of vertical adjustment of cushion 12, and hence that cushion may be completely removed from support member 29.

In this fashion, both horizontal and vertical adjustment of the back support cushion is provided for through use of flexible position stops which are simple to fabricate and install, and susceptible of easily understood and conveniently simple operation by the user of a chair.

While the invention has been shown and described above with reference to a preferred embodiment thereof, it will be understood by those skilled in the art that various changes in form and details may be made therein without departing from the spirit and scope of the invention. The invention, accordingly, should be taken to be defined by the following claims.

We claim:

1. Apparatus for adjusting a back support member of flat rigid material forming a part of a chair, comprising a bracket through which said back support member slides, a position stop of flat and flexible sheet material mounted adjacent to and lying flat against said back support member, said position stop including a first part affixed to said bracket and a second part which may be flexed with respect to said first part, a stop member carried by and protruding away from said back support member, apertures in said second part of said position stop, said stop member being engaged with one of said apertures thereby locking said back support member in position, whereby said position stop may be flexed to a disengaged position in which said stop member is free from said apertures and said back support member may be moved within said bracket to another position in which said position stop may be allowed to return to engaged position in which said stop member engages another aperture.

2. Apparatus according to claim 1, including a groove in said back support member, and a second stop member affixed with respect to said bracket and positioned within said groove, said second stop member coacting with said groove to permit limited sliding movement of said back support member within said bracket.

3. Apparatus according to claim 2, in which said stop member protrudes away from said back support member for a distance no greater than about the thickness of said flexible sheet material in the region of said second part, thereby retaining said stop member substantially hidden from view.

* * * * *